US008032948B2

(12) United States Patent
Anderson

(10) Patent No.: US 8,032,948 B2
(45) Date of Patent: Oct. 11, 2011

(54) GARMENT WITH INTEGRAL GARMENT PACK

(75) Inventor: Seth I. Anderson, Grand Junction, CO (US)

(73) Assignee: Loki, LLC, Grand Junction, CO (US)

( * ) Notice: Subject to any disclaimer, the term of this patent is extended or adjusted under 35 U.S.C. 154(b) by 905 days.

(21) Appl. No.: 12/070,512

(22) Filed: Feb. 19, 2008

(65) Prior Publication Data

US 2009/0205102 A1 Aug. 20, 2009

(51) Int. Cl.
*A41D 13/00* (2006.01)

(52) U.S. Cl. ..... 2/69; 2/86; 2/94; 224/153

(58) Field of Classification Search ..... 2/69, 71, 2/72, 86, 89, 94, 301; 224/153
See application file for complete search history.

(56) References Cited

U.S. PATENT DOCUMENTS

| | | | | |
|---|---|---|---|---|
| 2,058,474 | A | 10/1936 | Lona | |
| 2,146,243 | A | 2/1939 | Aug | |
| 2,248,455 | A * | 7/1941 | Freund | 2/94 |
| 2,292,347 | A | 8/1942 | Bailey | |
| 2,324,722 | A | 7/1943 | Papierniak | |
| 2,825,902 | A | 3/1958 | Breier | |
| 4,404,687 | A | 9/1983 | Hager | |
| 4,476,587 | A | 10/1984 | Itoi | |
| 4,483,469 | A | 11/1984 | Arisland | |
| 4,502,155 | A | 3/1985 | Itoi | |
| 4,689,831 | A | 9/1987 | Greenberger et al. | |
| 5,123,117 | A | 6/1992 | Prendergast | |
| 5,987,644 | A | 11/1999 | Mengato | |
| 6,564,388 | B1 | 5/2003 | Poston | |
| 6,996,847 | B2 | 2/2006 | Anderson et al. | |
| 7,788,736 | B2 * | 9/2010 | Gollin | 2/94 |
| 2005/0091724 | A1 * | 5/2005 | Snyder et al. | 2/86 |

* cited by examiner

*Primary Examiner* — Khoa Huynh
*Assistant Examiner* — Alissa Tompkins
(74) *Attorney, Agent, or Firm* — Allen H. Erickson

(57) ABSTRACT

An upper-body garment has an invertable pocket in the garment's back, formed between an exterior layer and an interior lining layer of the back panel. A vertical pocket opening on one side of the back panel permits ready access to the pocket while wearing the garment. Shoulder straps and pockets are formed within the invertable pocket. The pocket linings and straps may be drawn out to invert the pocket into a backpack configuration. The remainder of the garment may be entirely placed in the backpack and carried therein.

15 Claims, 12 Drawing Sheets

GARMENT WITH INTEGRAL GARMENT PACK

BACKGROUND OF THE INVENTION

1. Field of the Invention

The present invention relates generally to upper body garments such as coats, jackets, sweaters, sweat shirts and the like, and means for conveniently carrying the garment on-body when not in use. More particularly, the invention pertains to a garment convertible into a backpack which contains the garment, and methods for making same.

2. State of the Art

The usefulness of backpacks for carrying heavy and/or bulky items on the back has long been recognized. A plethora of backpack designs is commercially available. Such backpacks may be as simple as the well-known Duluth backpack which comprises a deep woven basket with shoulder straps, or may be complex with a rigid frame, fabric container attachable to the frame and having numerous pockets, a myriad of adjustment straps, waist-strap and shoulder straps. Such backpacks are complex, relatively heavy, and time-consuming to fabricate. They are generally not suitable for day-hiking and the like.

Backpacks of limited capacity have been proposed. For example, in U.S. Pat. No. 5,987,644 to Mengato, a fabric backpack is shown which is attached at its periphery to the back panel of an athletic shirt. A horizontal zippered opening at the top of the backpack provides access to the backpack. No straps are provided, so the combination can be used as a backpack only by wearing the garment.

A common experience of hikers, bikers, golfers, boaters, anglers, hunters, campers, climbers and other outdoorsmen and outdoorswomen is the normal changeability of weather conditions. As a result of changes in temperature, wind speed, cloudiness, and precipitation, a person may need to add or remove outer clothing to remain comfortable. Changes in outer dress may also be necessitated by changing levels of personal exertion, health considerations and the like. The concept of "layering" is well-known as a means to be comfortable in spite of changing weather conditions, personal exertion, and other factors.

Where circumstances make removal of an outer garment desirable, means for carrying the garment in a small package is advantageous. Various devices for carrying a garment have been proposed in the prior art. An example of such an apparatus is found in U.S. Pat. No. 6,564,388 to Poston, wherein the garment is configured to be folded into a carry bag which may be hand-carried or, alternatively be located within a separate pack which is placed within the inside front of the garment. The design requires carrying of the separate pack in the front of one's person, which is very uncomfortable, and/or hand-carrying of the bag, which will occupy one of the person's hands. This is very inconvenient, inasmuch as people who are engaged in hiking, climbing, skiing, fishing, hunting, shopping, or other common outdoor activities will not want to have only one hand available for these activities.

Another type of garment carrying container is found in U.S. Pat. No. 4,689,831 to Greenberger et al., in which a backpack with shoulder straps is attachable to the outer back panel of a jacket. The jacket may be folded and placed in the backpack, and the straps used to carry the backpack. When worn as a jacket, the backpack portion is always a conspicuous "hump" on the back of the wearer.

In U.S. Pat. No. 2,825,902 to Breier, a jacket is shown in which a pocket is formed between the arm holes and neck i.e. the two-ply yoke area by sewing a generally triangular panel to the exposed surface of the inside jacket lining. A zipper located at the bottom of the pocket provides access thereto from within the jacket. The zipper is inaccessible when the jacket is worn. The jacket can be folded into the pocket to form a closed carrying case for hand carrying.

In U.S. Pat. No. 4,483,469 to Arisland, a vest is shown which is foldable into two separate attached containers which are joinable into a purse.

U.S. Pat. No. 5,123,117 to Prendergast depicts a reversible jacket in which a backpack is attached to the outer surface of the jacket back. When the jacket is reversed, the backpack is hidden within the jacket. The jacket may be folded against the backside of the backpack and covered by a flap normally rolled up at the bottom of the backpack.

In U.S. Pat. No. 4,404,687 to Hager, a pullover jacket is configured to collapse into a handbag for carrying. The empty handbag is attached to the inner front of the jacket, and includes strap handles.

U.S. Pat. No. 2,058,474 of Long describes a garment with an integral carrying bag with two handles, mounted on the interior of the back panel of a garment. Matching zipper strips surround the bag opening. This arrangement has a definite disadvantage in that the sharp exposed (i.e. open) zippers tend to catch and tear garments worn beneath the outer garment. A similar construction is shown in U.S. Pat. No. 2,146,243 to Aug.

U.S. Pat. No. 2,292,347 to Bailey shows a garment having a hanging panel attached to the inside back of a garment by a central horizontal sew-line. The panel has opposed matching zippers at the top and bottom edges. The garment may be folded up against the hanging panel and the zippers closed to enclose the garment. The hanging panel with exposed zippers is seen to be uncomfortable, and it is well known that free (unclosed) zippers tend to catch on fabric which they touch.

In U.S. Pat. No. 2,324,722 to Papierniak, a jacket is shown having a front pocket within which is attached a lined tab with buttonholes. Matching buttons are attached within the pocket. When the tab is pulled from the pocket and the garment carefully folded about the exterior of the pocket, the pocket may be inverted about the jacket to form a package.

U.S. Pat. No. 4,502,155 to Itoi describes outerwear having a complex structure for enclosing the outerwear in a backpack. The backpack is formed of two layers sewn along the upper edge to the back of a garment and held by "engaging members" such as snaps at the bottom corners. Thus, the backpack hangs generally loosely from the jacket back. The backpack has multiple zippers, chuck webs, engaging members and connectors. Shoulder straps are attached to the inside surface of the jacket back.

Another complex backpack design in the prior art is found in U.S. Pat. No. 4,476,587 to Itoi. The jacket is bisected transversely by front and back zippers. When these zippers are opened, the jacket is divided into a top portion and a bottom portion. The front and back zippers may then be joined to form an upside down bag. The bag may be pulled closed by strings sewn into the bottom edge of the jacket, and the exposed strings used to carry the bag.

Each of the above-described prior art references has disadvantages in complexity of construction with concomitant high cost, inconvenience in use, poor appearance, and/or lack of achieving the desired goals. The use of horizontally oriented zippers for supporting garment carrying containers leads to detachment of the zipper rails because of cross forces exerted on the zipper joint. None of the prior art references describes a conventional-appearing garment which has a hidden backpack construction not visible in its general appearance when worn.

BRIEF SUMMARY OF THE INVENTION

It is an object of the invention to provide an upper body garment such as a jacket, shirt, sweatshirt or sweater, for example, with a construction enabling the garment to be removed and carried separately as a backpack, thereby avoiding hand carrying which limits other usage of the arms and hands.

Thus, it is an object of the invention to provide such an upper body garment which enables conversion of the garment into its own carrier with backpack straps.

Another object of the invention is to provide an upper body garment having an integral backpack construction for stowing and carrying the garment and other items without having the inherent problems of the prior art.

A further object of the invention is to provide an upper body garment incorporating its own integral carrier which is substantially unseen when the garment is worn.

Another object of the invention is to provide, in one embodiment, an upper body garment in which an improved backpack feature is formed in a lined garment without requiring additional fabric backpack panels.

An additional object of the invention is to provide an upper body garment with a pocket which is easily accessible when the garment is worn, wherein the pocket is convertible by inverting into a backpack for carrying the garment as well.

A further object of the invention is to provide a manufacturing method for a self-contained garment carrier integrally forming part of an upper body lined garment, wherein no additional panels are required, the pack is easily opened by a convenient closure device, one or more pocket is provided for carrying other objects, and the pack has integral backpack carrying straps.

Another object of the invention is to provide an improved reversible garment with an integral pack feature having optional opposed pack openings easily accessible during wear in either of the reversible configurations.

Other objects and considerations of the invention will become apparent in the following detailed description of the invention when taken in conjunction with the attached drawings.

In accordance with the invention, an upper body garment such as a jacket, coat, sweater, shirt, sweatshirt and the like (all encompassed herein by the term "outerwear") is provided with means for self-collapse, i.e. into itself, forming a self-carryable pack with integrated shoulder straps for toting as a backpack. For purposes of this application, the self-packable garment may be described as having an outer shell layer and an inner lining layer. Furthermore, either of these layers may in actuality comprise a plurality of individual panels of fabric, insulative materials, polymeric film, leather and the like.

The pack so formed may exist as an accessible invertable pocket formed by the outer garment shell and the garment lining. Conversion to a backpack entails inverting the pocket so that the inner pocket faces become the exterior of the backpack, with attached shoulder straps. An access opening into the pocket comprises a generally vertical elongated passage on one side of the garment back, preferably substantially below the armpit of the garment, i.e. near the side edge of the back of the shell. This position enables a wearer to place/remove objects into/from the pocket while wearing the outerwear. Thus, the pocket is useful for carrying objects in its normal configuration, but may be inverted to become a garment-carrying backpack. Secondary pockets may be formed within the invertable pocket for storage of smaller items. The backpack is formed of portions of some of the garment panels, and may be enhanced with additional interlayers of fabric, insulation, etc. between the outer shell layer and the inner lining layer.

The garment with integrated pack is particularly useful for outdoor wear under changeable weather conditions or changing activity levels. The backpack feature may be configured to be very inconspicuous. Thus, the thickness dimension of the backpack appears to be no greater than the thickness of the other portions of the garment.

BRIEF DESCRIPTION OF THE DRAWINGS

The invention is illustrated in the following figures, wherein.

DESCRIPTION OF THE PREFERRED EMBODIMENTS

Figure 1:
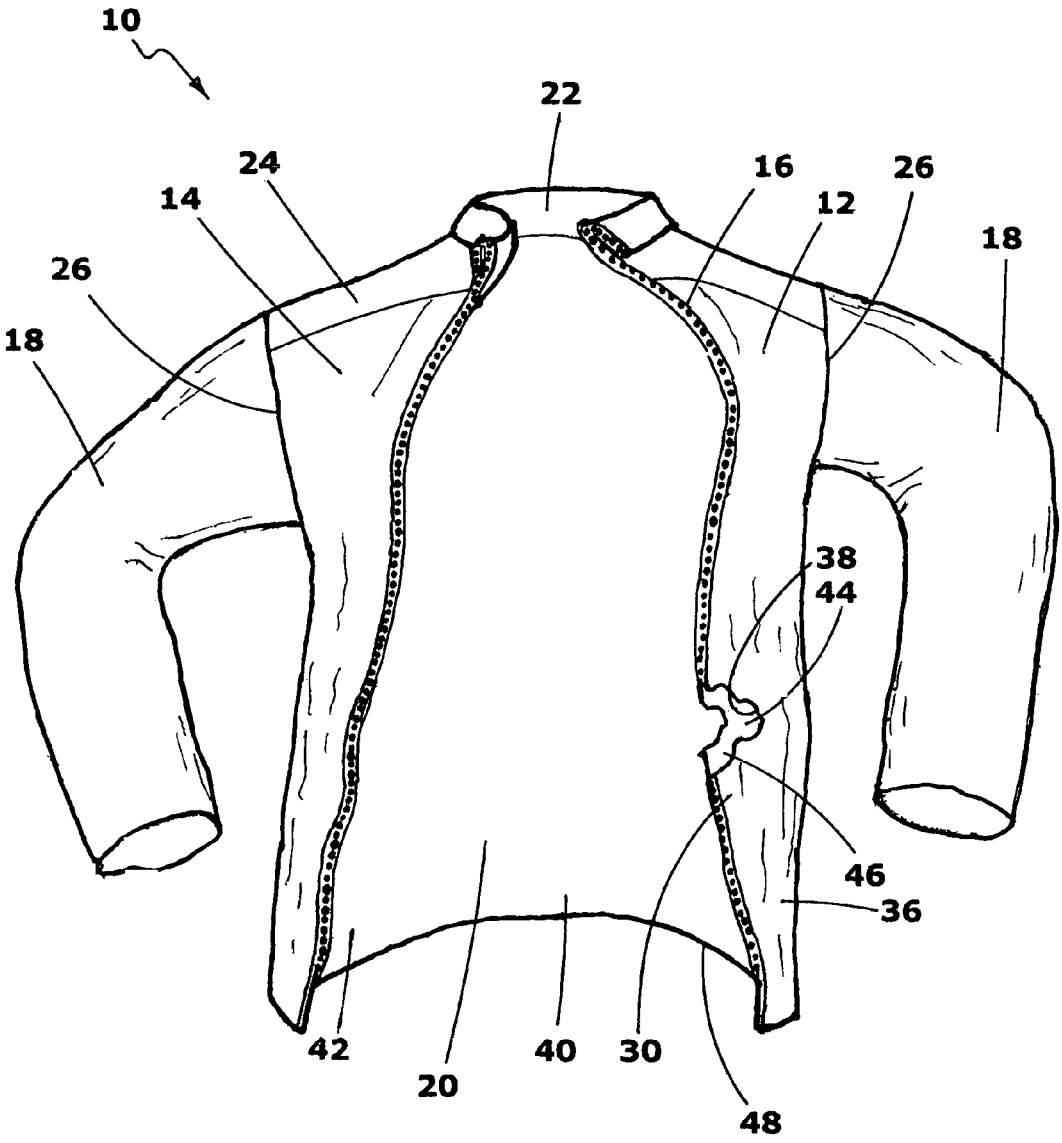
FIG. 1 is a general schematic frontal view of a lined upper body garment of an embodiment of the invention showing its general appearance.
Figure 2:
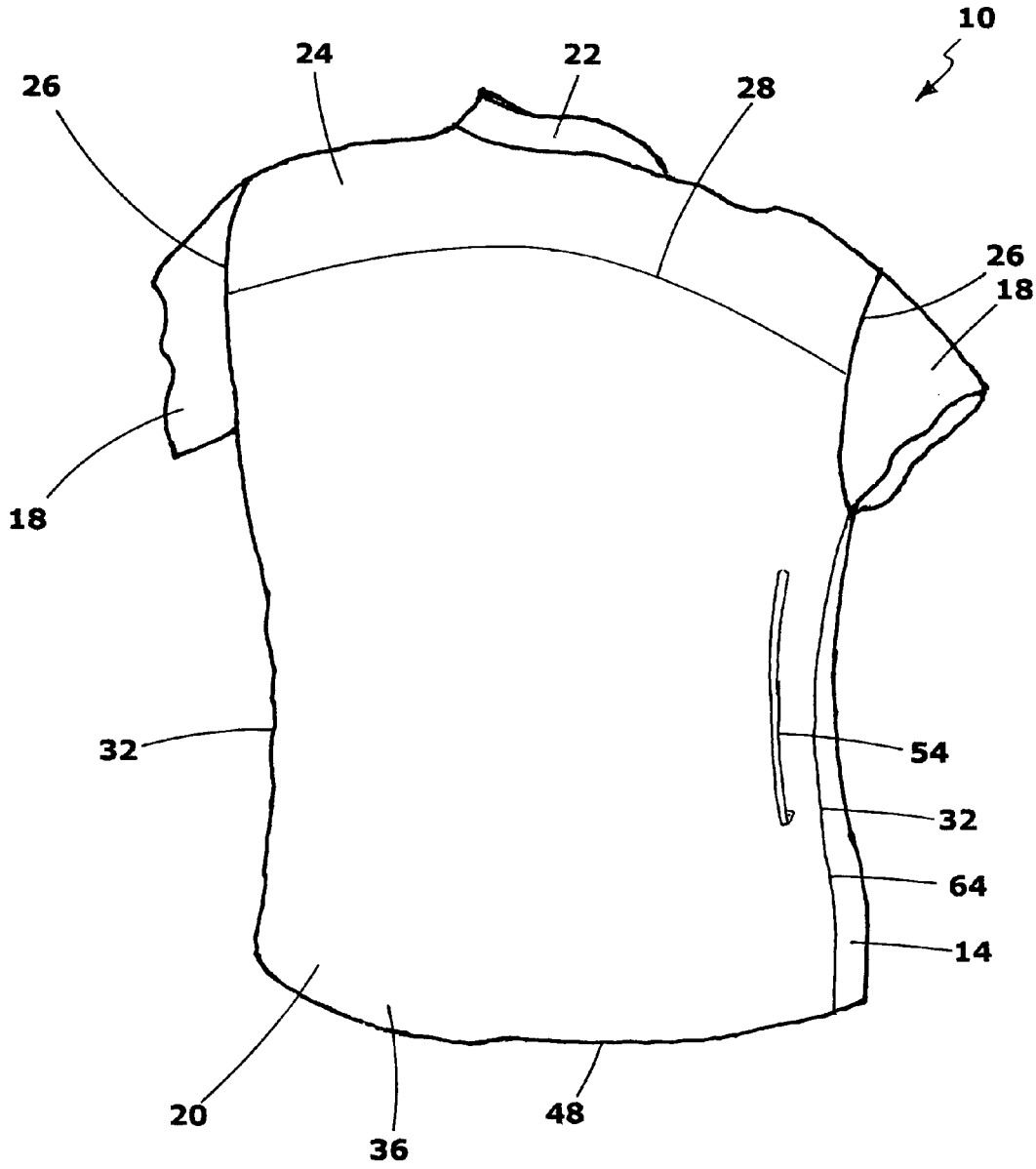
FIG. 2 is a general, partial, cut away rear view of a lined upper body garment of the invention, showing its general appearance.
Figure 3:
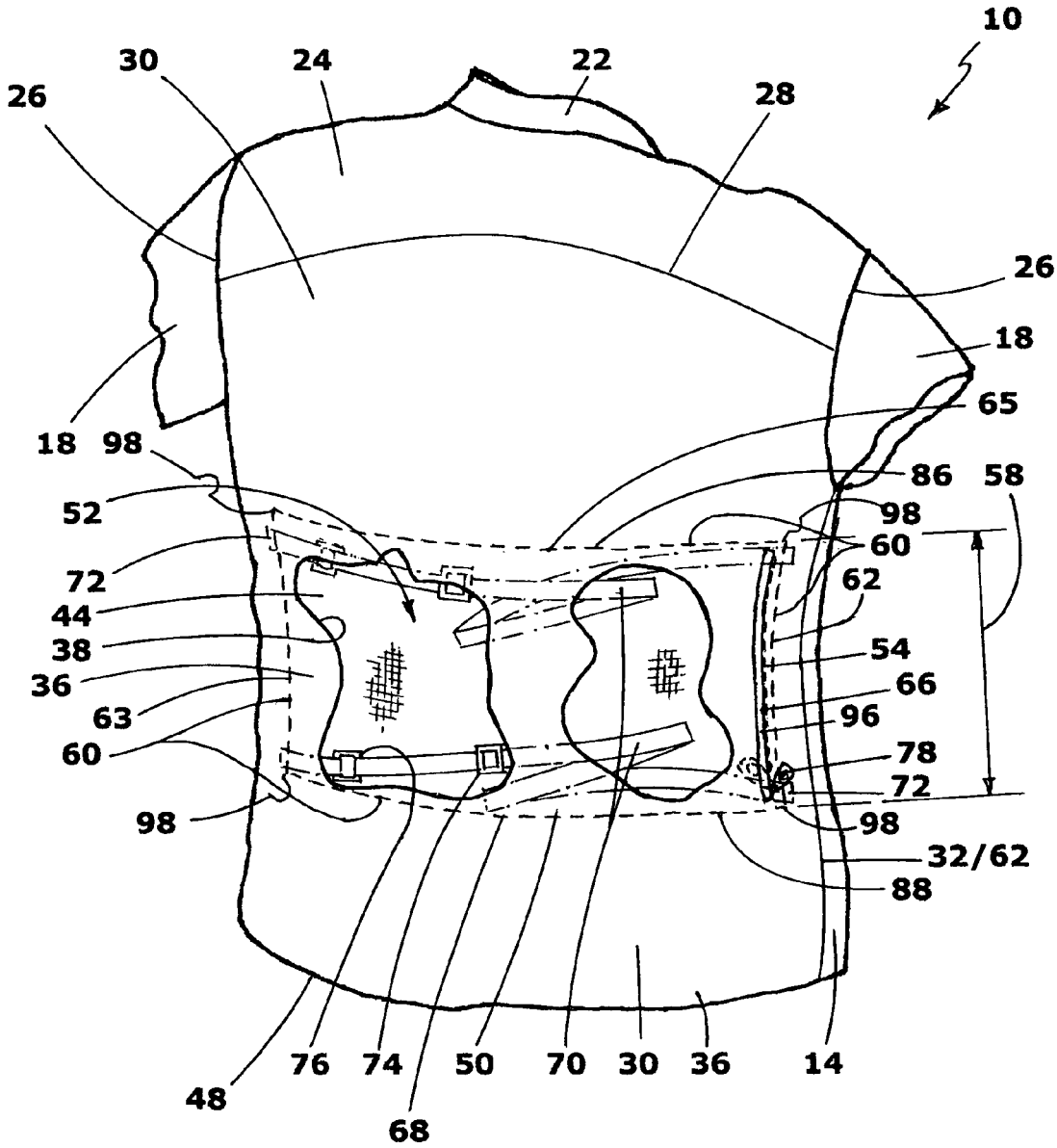
FIG. 3 is a partial, cut-away rear view of an upper body garment of one embodiment of the invention, showing the structure of an integral concealed backpack construction.

As shown in FIGS. 1 and 2, an upper body garment 10 according to one embodiment is depicted in front and rear views. The upper body garment 10 includes a left front portion 12, a right front portion 14, a back portion 20, sleeves 18, and a shoulder portion or yoke 24. The front portions 12 and 14 are joinable by a front fastener 16 shown as a zipper. The front fastener 16 may optionally comprise buttons, hook-and-loop materials, snaps, or other fasteners as known in the art. Typically, fastener 16 is centrally positioned in a vertical orientation as shown, although other configurations may be utilized. The sleeves 18 may be of any convenient length, or garment 10 may be sleeveless. In FIGS. 2, 3, and 7, the garment is depicted with shortened sleeves 18 for convenience of illustration. The garment 10 is also depicted with an abbreviated collar 22, but a collar of any style may be used. A hood, either fixed or detachable, may be mounted in the collar area but is not shown in FIGS. 1-8. Furthermore, the sleeves may be fitted with permanently attached or removable hand coverings, particularly where the garment is to be used in cold weather. For example, convertible hand coverings shown in U.S. Pat. No. 6,996,847 to Anderson et al. may be incorporated into the sleeves 18 of garment 10.

As will be seen, the exemplary upper body garment 10 of FIGS. 1 and 2 may be a shirt, sweater, sweat-shirt, vest, jacket, or other garment 10 designed for upper body use. As will be later described, the invention is also applicable to coats/jackets with a fixed or removable insulative layer, and may be adapted to reversible garments 10, and even to lightweight single-layer garments. While the invention may be usefully incorporated into an upper body garment having any pattern, i.e. configuration of panel shapes, it will be illustrated herein as applied to upper body garments with conventional patterning. Typically, the garment panels are joined by sewing, although other joining means may be used, e.g. glue. Seam 60 is particularly relative to the invention, and is represented in the drawings by hatched lines. The seam 60 may be a single, dual, or triple line of stitching, dependent upon the expected stress on the seam.

The exemplary upper body garment 10 is shown in FIGS. 1 and 2 with long sleeves 18 joined at a sleeve hole or openings 26 which is formed at the intersection of the back portion 20, one of the front portions 12 or 14, and a yoke panel 24. The back portion 20 is joined (as by sewing) at its upper edge 28 and opposed lateral edges 32 to front portions 12 and 14, for enclosing a person's torso. An optional hood may be permanently or removably joined adjacent to or in place of collar 22. Thus, the invention is applicable to upper body garments irrespective of sleeve length or the presence of a collar, hood, or insulative layer.

As shown in FIG. 1, the front portions 12, 14 and back portion 20 of the exemplary garment 10 are formed in two layers, i.e. an exterior layer or shell 30 and an interior layer 40 which is configured as a liner. The interior lining layer 40 is typically generally coextensive with the exterior layer 30, creating a variable space 46 therebetween. The exterior layer 30 (e.g. shell) and interior layer 40 (i.e. liner) are formed of materials which provide the desired protection and comfort for the wearer. Thus, for example, the garment 10 may be a jacket with an exterior layer 30 having a water resistant outer surface 36 and inner surface 38, and an interior layer 40 having a smooth outer surface 42 and an insulative inner surface 44.

In another example, the garment 10 may have one or both layers 30, 40 composed of so-called "breathable" fabrics. The particular fabrics comprising the layers are thus dependent upon the intended use. Typically, the sleeves 18 are also lined with the same material as the front and back portions 12, 14, and 20, but the sleeves may alternatively be unlined or be lined with different materials. It will be shown, infra, that intermediate layers and even a detachable liner layer (not shown in FIGS. 1 and 2) may also be formed in the garment 10.

Turning now to FIG. 3, a rear view of a first embodiment of an upper body garment 10 of the invention is depicted. An invertable pocket 50, shown in cutaway, is formed between the exterior layer 30 and interior layer 40 of the back portion 20 by linearly attaching the two layers together in a circumscribing manner to enclose an interior space 52 comprising pocket 50. Typically, the exterior layer 30 and interior layer 40 are joined by sewing with thread along circumscribing seam 60. FIG. 3 depicts seam 60 in a preferred configuration, i.e., a rectangle formed by upper side 65, lower side 68, left side 63 and right side 62. The pocket 50 so formed is of a size which, when it is inverted by pulling the pocket outward, will form a backpack 100 which will fully carry the garment 10. See FIGS. 5 and 6.

Figure 4:
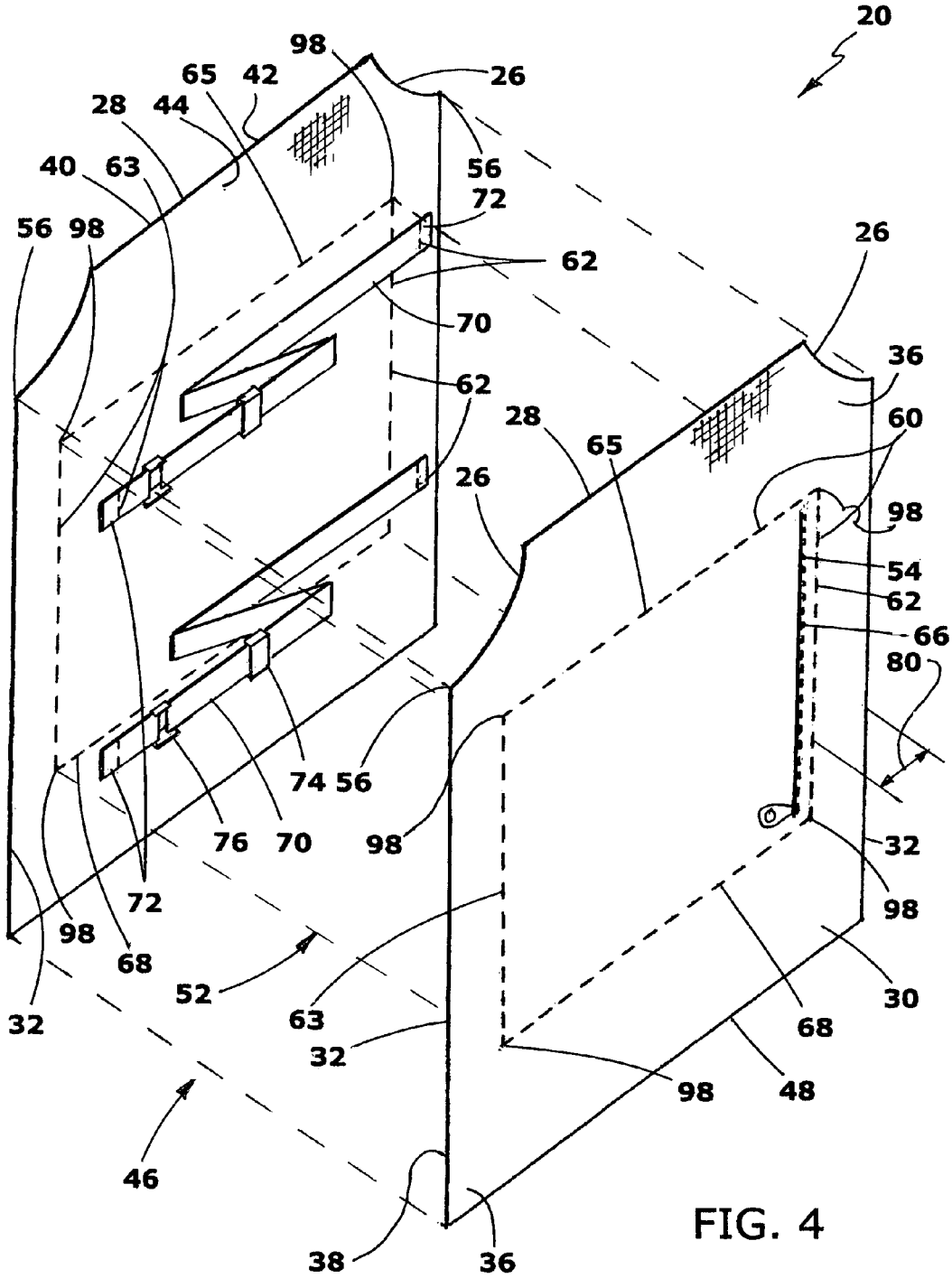
FIG. 4 is a perspective rear view of outer and inner layers of a back panel, shown in exaggerated spaced-apart relationship, of an upper body garment in accordance with one embodiment of the invention.

As depicted in FIG. 3, invertable pocket 50 is positioned in the middle and/or lower region of the back portion 20, and is preferably generally rectangular in shape, as shown, to enhance ease of manufacture. Invertible pocket 50 is defined by circumscribing seam 60, which is shown with an upper side 65, lower side 68, and opposed lateral vertical edges 62 and 63. Preferably, the invertable pocket 50 extends to within no more than about 6 inches of a vertical line 64 generally extending through a central axis 56 of sleeve hole 26 (See FIGS 2 and 4). As shown in FIG. 4, this distance 80 enables a pocket opening 54 to be formed which is easily accessible to a garment wearer without removing the garment 10.

As depicted in FIG. 3, vertical pocket opening 54 is formed inside the circumscribing seam 60, substantially adjacent one of the generally vertical sides 62, 63 of circumscribing seam 60, for hand access to the invertable pocket 50. This pocket opening 54 is formed through the exterior layer 30 and extends across a major portion of the vertical dimension 58 of pocket 50 between the upper side 65 and lower side 68.

Closure means 66 such as a zipper, buttons, snaps, hook-and-loop materials, or the like is fitted to the exterior layer 30 in the pocket opening 54. A preferred closure means 66 is a zipper with a dual-handle zipper pull 78. One or more welts 96 may be formed adjacent the closure means 66 for protection thereof and to substantially hide the closure. The vertical pocket opening 54 with closure means 66 is the only exterior evidence of the presence of a backpack 100 in garment 10, and merely appears to be a pocket. The vertical pocket opening 54 may even be located directly below a sleeve hole 26 of the upper body garment 10, where it may be relatively undetectable during wear. Thus, the pocket location provides easy access to the wearer for inserting items into, or taking items from the pocket 52 while wearing the garment 10.

In accordance with the invention, backpack straps 70 are also contained within the pocket 52, and are shown in FIG. 3 as having strap ends 72 generally attached by circumscribing seam 62 at or near opposed corners 98, thus horizontally spanning the pocket 50 between seam side 62 and seam side 63. Generally, strong attachment of the strap ends 72 to the pocket seam 60 is ensured by a plurality of sew lines through the straps 70. Backpack straps 70 are preferably fitted with buckles 74 enabling changes in strap length to be made for comfortable fit, and/or openable strap connectors 76 for donning and removing the backpack 100. Optionally, a sternum strap 78 may be attached between straps 70 for further comfort, and/or a waist belt 82 attached within pocket 50 for steadying the backpack 100 during strenuous activity (see FIGS. 6, 7 and 8).

Turning now to FIG. 4, which illustrates the construction of pocket 50 which upon inversion becomes a garment-carrying backpack 100. As shown, the garment back portion 20 is represented as comprising an exterior layer or shell 30 and an interior or lining layer 40, which are generally coextensive. Each layer 30, 40 has an upper edge 28, lower edge 48, and lateral edges 32, and the layers are joined along the respective edges and to the other garment portions 12, 14, 18, 22 and 24 following assembly of the invertable pocket 50 in the back portion 20. Typically, conventional sewing methods are used to join the garment portions, whereby folded edges (not shown in the figures) are within the garment and not open to view.

Assembly of the invertable pocket 50 entails positioning the shoulder straps 70 so that the strap ends 72 extend across opposed corners 98 of the lateral sides 62, 63 of intended circumscribing seam 60. Thus, joining of exterior layer 30 to lining layer 40 may be completed by sewing along the seam 60 which simultaneously forms pocket 50 and attaches the shoulder straps 70 in their proper positions. The variable space 52 within pocket 50 may be increased by parting the two layers 30, 40 within the pocket, and decreased by compressing the two layers together. Pocket closure means 66, such as a zipper, is attached to pocket opening 54, enabling the pocket to be opened and closed. The completed back portion 20 is joined to front portions 12, 14 and yoke panel 24, and other portions such as, for example, sleeves 18, collar 22, and front fastener 16, typically by sewing, to complete the garment. It is noted that when this embodiment of garment 10 is converted to a backpack 100 (see FIG. 5), pocket side 62 with inverted pocket opening 54 of the backpack is positioned at the upper end 102 when toted. Side 63 of pocket 50 is positioned at the lower end 104 of the backpack 100.

Figure 5:
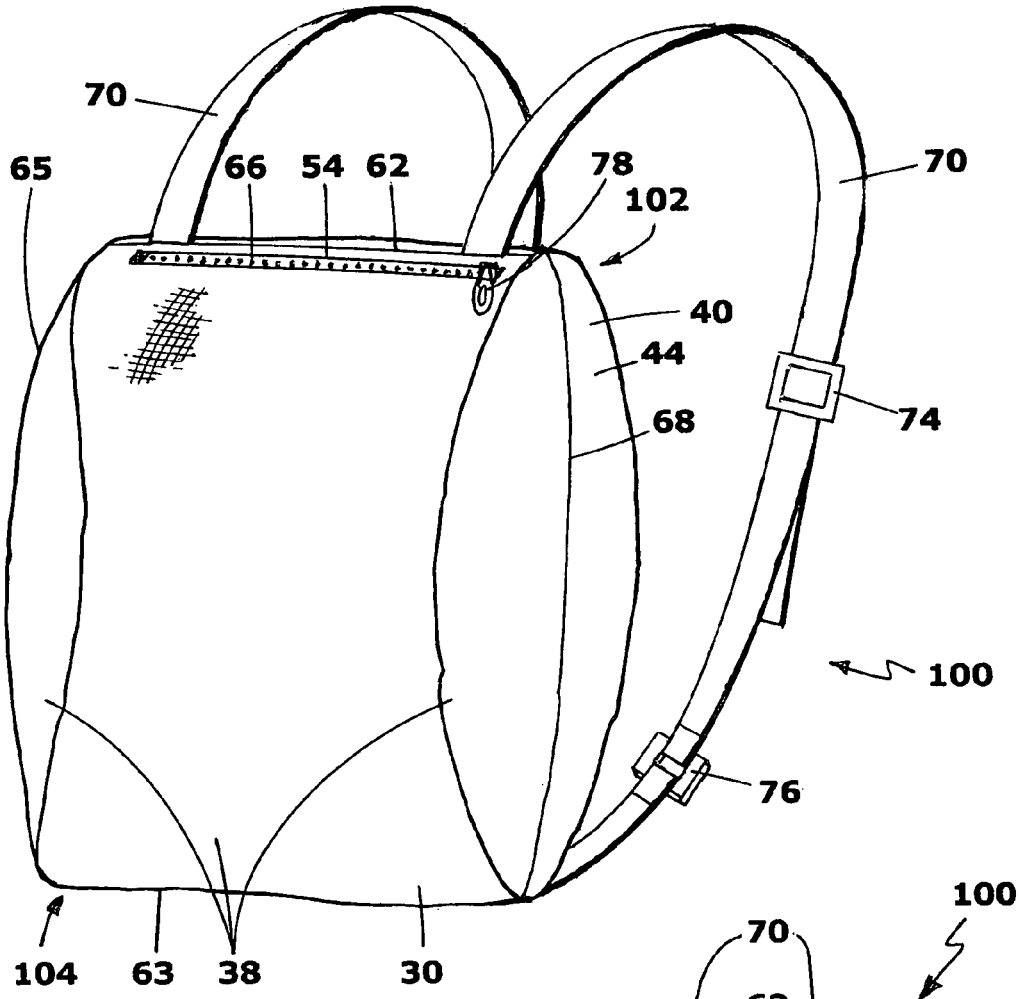
FIG. 5 is a general rear view of an upper body garment self-carried in a backpack mode, in accordance with one embodiment of the invention.
Figure 6:
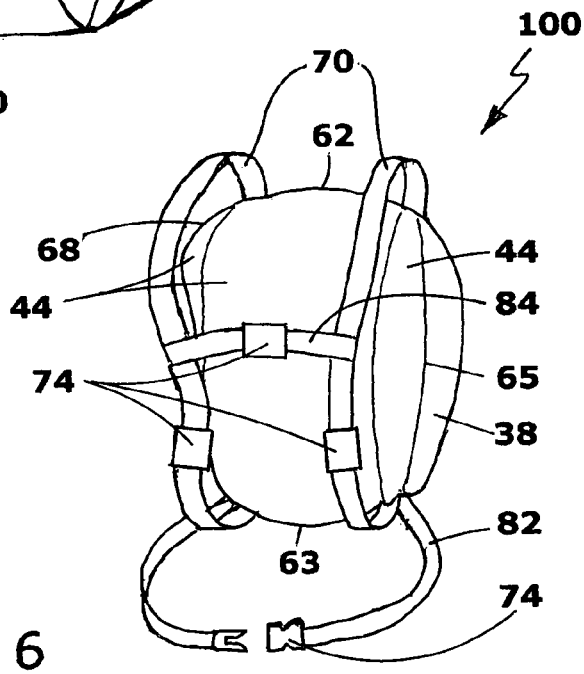
FIG. 6 is a general frontal view of an upper body garment self-carried in a backpack mode, in accordance with another embodiment of the invention.
Figure 7:
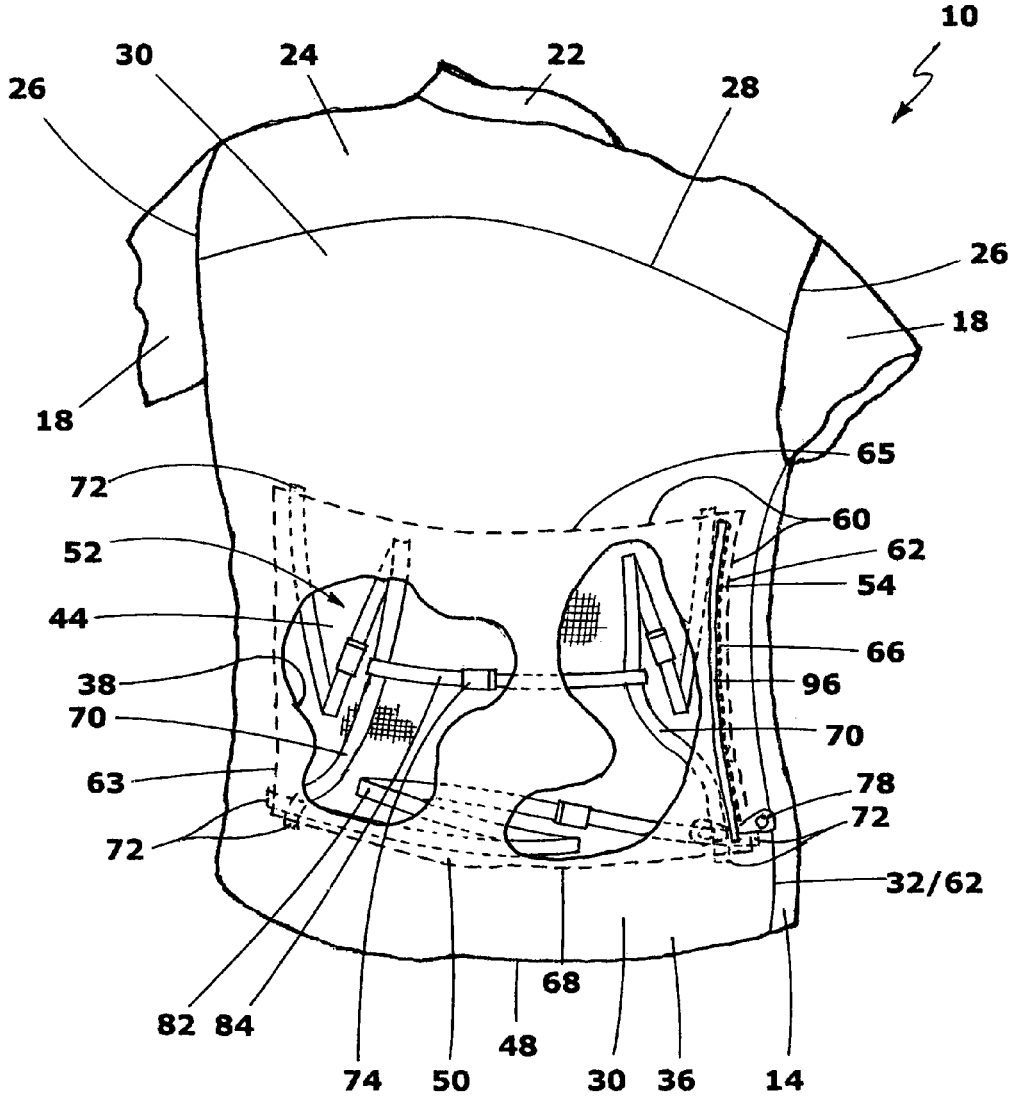
FIG. 7 is a partial, cut-away rear view of an upper body garment of another embodiment of the invention, showing the structure of an integral concealed backpack construction.

FIGS. 5 and 6 illustrate the garment-enclosing backpack 100 of this first embodiment. To form the garment-containing backpack 100, the pocket closure means 56 (FIG. 4) is opened, and a hand inserted therein to grasp the inner pocket surfaces 38, 44 and shoulder straps 70. The inner surfaces 38, 44 and shoulder straps 70 are pulled outward through the pocket opening 54, thereby inverting the pocket 50. Thus, the inner surface 38 of the exterior layer 30, and the inner surface 44 of the interior layer 40, respectively, become the outer surfaces of the backpack 100 formed thereby. The pocket side 63 is positioned as the upper end 102 of the backpack 100, and pocket side 63 is positioned as the lower end 104 of the backpack. The garment 10 is then stuffed into the open backpack 100, and closure means 66, now positioned at the upper end 102 of the backpack 100, may be closed. Upper side 65 and lower side 68 of circumscribing seam 60 become lateral sides of the backpack 100. Use of a zipper with dual pulls 78 as closure means 66 enables opening 54 to be opened and closed in either of the garment or backpack modes. Conversion to a backpack 100 results in repositioning of the shoulder straps 70 from interior positions (within pocket 50) to exterior positions useful for carrying the backpack 100.

Because of the described construction, inversion of the pocket 50 results in a backpack 100 having slightly greater maximum capacity as the space 52 in the uninverted pocket. This because the space occupied by the shoulder straps 70 in pocket 50 is only partially offset by the space occupied by strap ends 72 and seam folds within the backpack 100.

To convert backpack 100 to a garment 10, the process is reversed. The garment 10 is simply pulled from the backpack 100 through opening 54, which action simultaneously reverts the backpack to a pocket 50.

FIG. 6 depicts a preferred feature of the backpack 100, wherein the two shoulder straps 70 are joined by a mid-strap sternum strap 84. Likewise, a waist belt 82 may be provided within the pocket 50. Both of these features become available for use when the first pocket is inverted, and add to ease of carrying the backpack 100.

Figure 8:
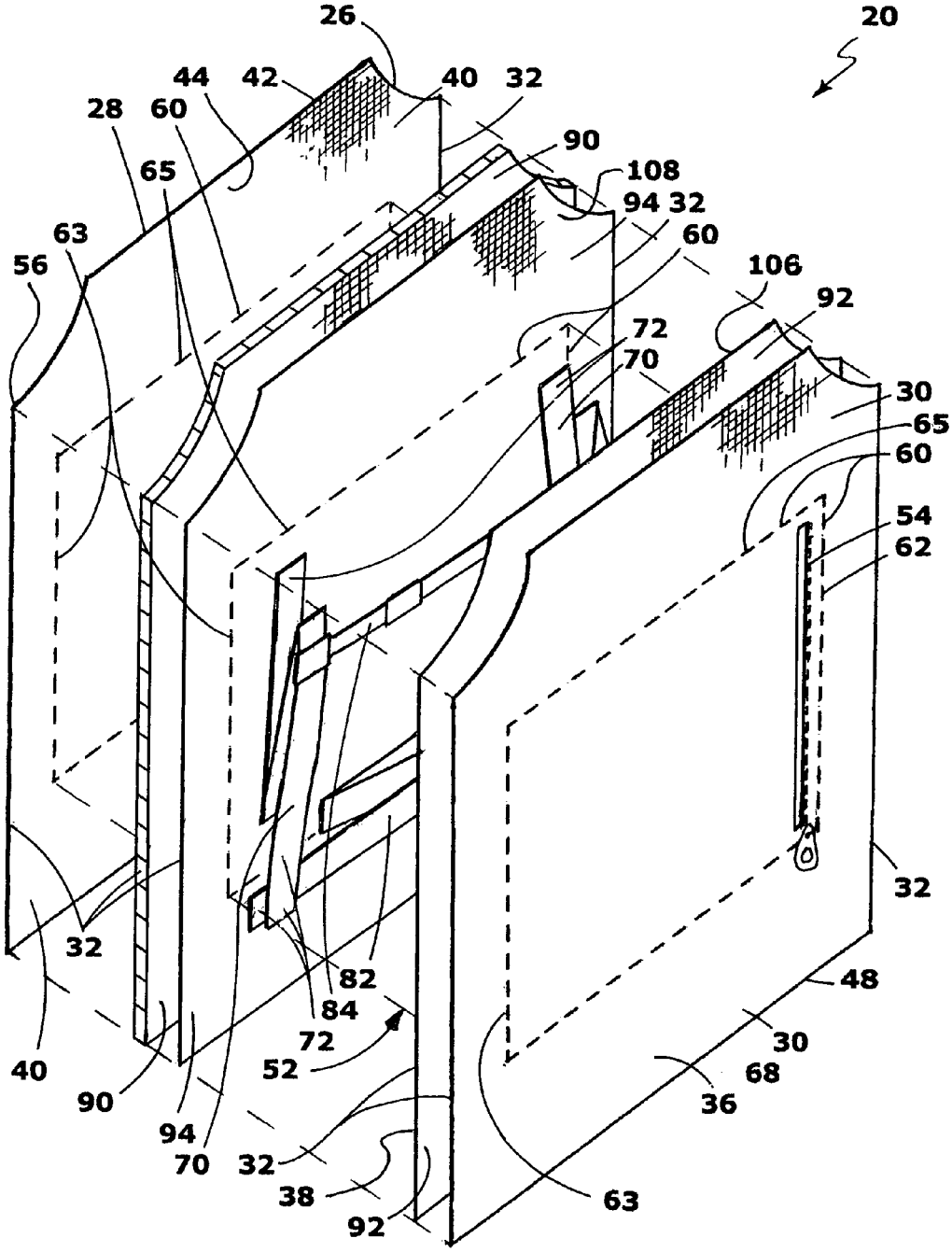
FIG. 8 is a perspective rear view of the outer, inner and intermediate layers of a back panel in exaggerated spaced-apart relationship, of another embodiment of an upper body garment in accordance with the invention.
Figure 9:
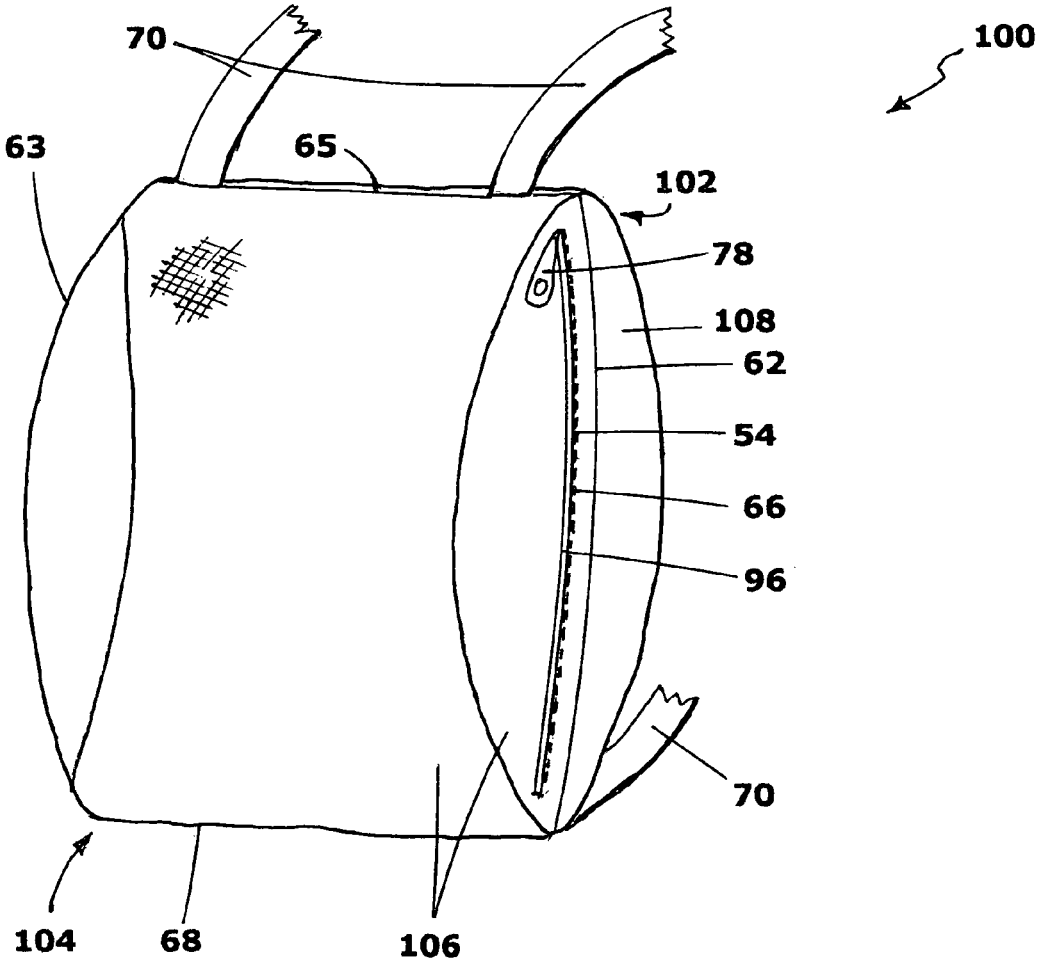
FIG. 9 is a general rear view of an upper body garment self-carried in a backpack mode, in accordance with another embodiment of the invention.

We turn now to FIGS. 7, 8, and 9. which show other alternative features of the convertible garment 10. As shown in FIGS. 7 and 8, the placement of shoulder straps 70 within pocket 50 is rotated 90 degrees from the prior embodiment of FIGS. 3-6. Thus, shoulder straps 70 span the pocket 50 vertically, and have their ends 72 attached by seam 60 on the upper side 65 and lower side 68 of the pocket. When the pocket 50 containing variable space 52 is inverted to form the backpack 50, the resulting backpack opening 54 is aligned vertically on a lateral area of the backpack 100 (see FIG. 9). Other features depicted in FIG. 7, including waist belt 82 and sternum strap 84, are substantially as described in relation to FIGS. 3 and 4.

Another feature illustrated in FIG. 8 is the inclusion of one or more interlayers 90, 92, and 94 positioned in the space 46 between the exterior layer 30 and the interior layer 40. The exterior layer 30 and interior layer 40 are configured as previously described. As shown, an interlayer 90 of insulative material may be included in the garment 10, preferably adjacent either the exterior layer 30 or interior layer 40. Interlayer 94 is shown as a protective layer between the insulative layer 90 and the pocket 50, and provides surface 108 of the pocket. Interlayer 92 is shown as a strengthening layer behind the lining layer 40, and providing surface 106 of pocket 50. Thus, in this example, the variable space 52 in pocket 50 lies between surfaces 106 and 108, bounded by seam 60. The number types, and arrangement of interlayers 90, 92, 94 will depend upon the characteristics of the exterior layer 30, interior layer 40 and functional requirements of the garment 10. As is well-known in the outerwear art, it is desirable to use fabrics having both high strength and lightness of weight. An excess of heavy layers of fabrics is known in the art to result in sewing difficulties. However, we have found that the invertable pocket 50 may be readily formed by sewing the circumscribing seam 60 in jackets having high loft insulation and several interlayers. Of course, the invertable pocket 50 is sized to fully contain the bulky jacket and optionally other items which may be carried therein.

In the embodiment of FIG. 8, it is noted that the pocket opening 54 passes through both of the exterior layer 30 and interlayer 92, and attachment of closure means 66 and welt 96 also includes joining of layer 30 to interlayer 92 about the pocket opening.

In FIG. 8, circumscribing seam 60 is shown as joining the exterior layer 30 and interior lining layer 40, together with all intervening layers 90, 92 and 94. Optionally, seam 60 may join less than all of the layers. Thus, for example, all layers except the inner lining layer 40, or inner lining layer 40 plus its underlying layer, exemplified by insulative layer 90 in the figure.

A backpack 100 which is formed by inversion of pocket 50 of FIG. 8 is depicted in FIG. 9. As a result of retracting the inner pocket surfaces 106, 108 from pocket 50, these surfaces become the exterior of backpack 100. In this preferred embodiment, the pocket opening 54, closure 66 and welt 96 become positioned vertically near a lateral edge 62 of back panel 30. The seam sides 62, 63, 65, and 68 are shown in the same orientation in either of the garment and backpack modes. An optional reversal of the backpack strap ends 72 will result in reversal in orientation of the upper side 65 and lower side 68 of the backpack 100, but the pocket opening 54 will remain in a vertical configuration on the backpack 100.

Figure 10:
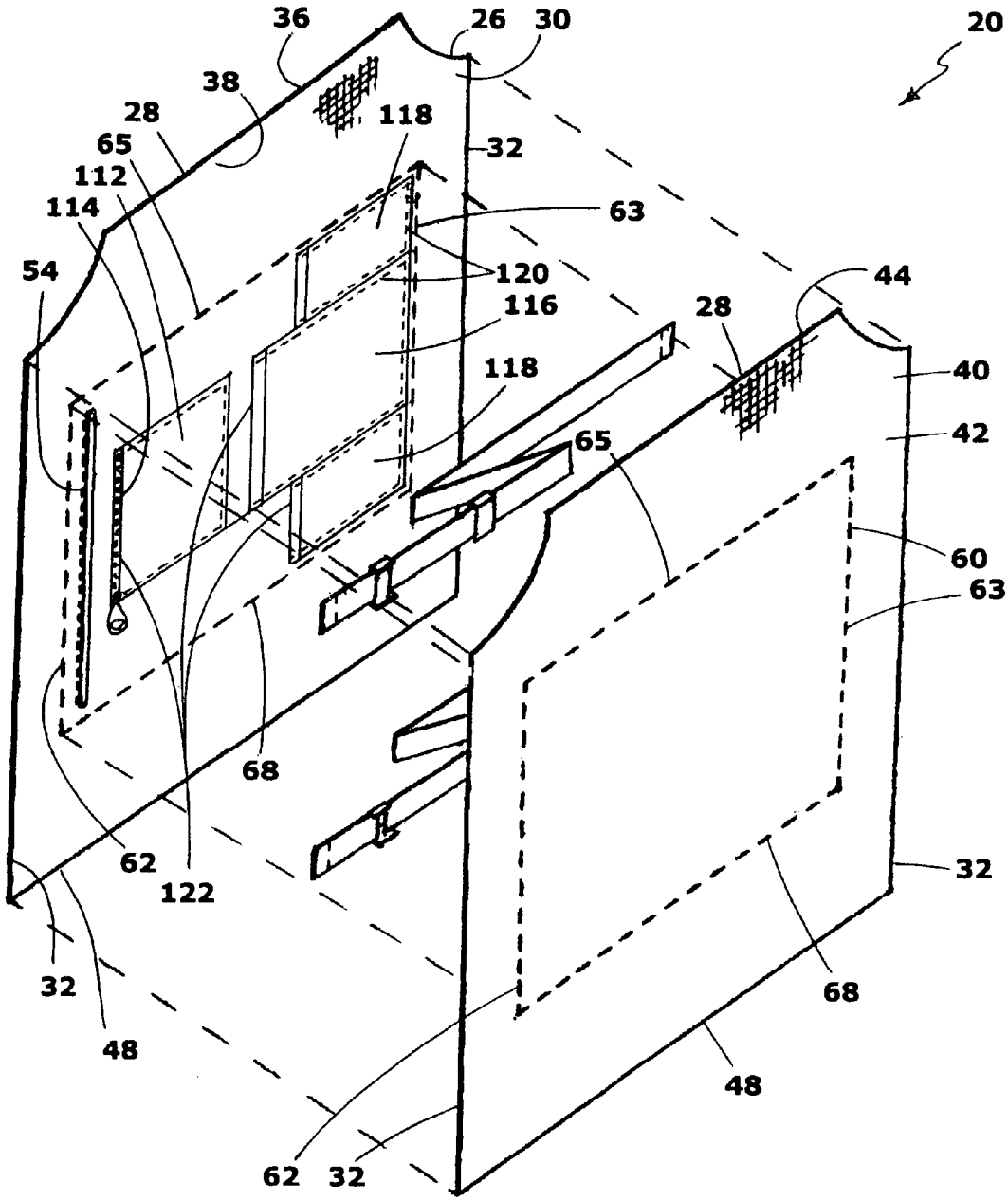
FIG. 10 is a perspective frontal view of inner and outer layers of a back panel of an upper body garment having added pocket features in accordance with the invention.
Figure 11:
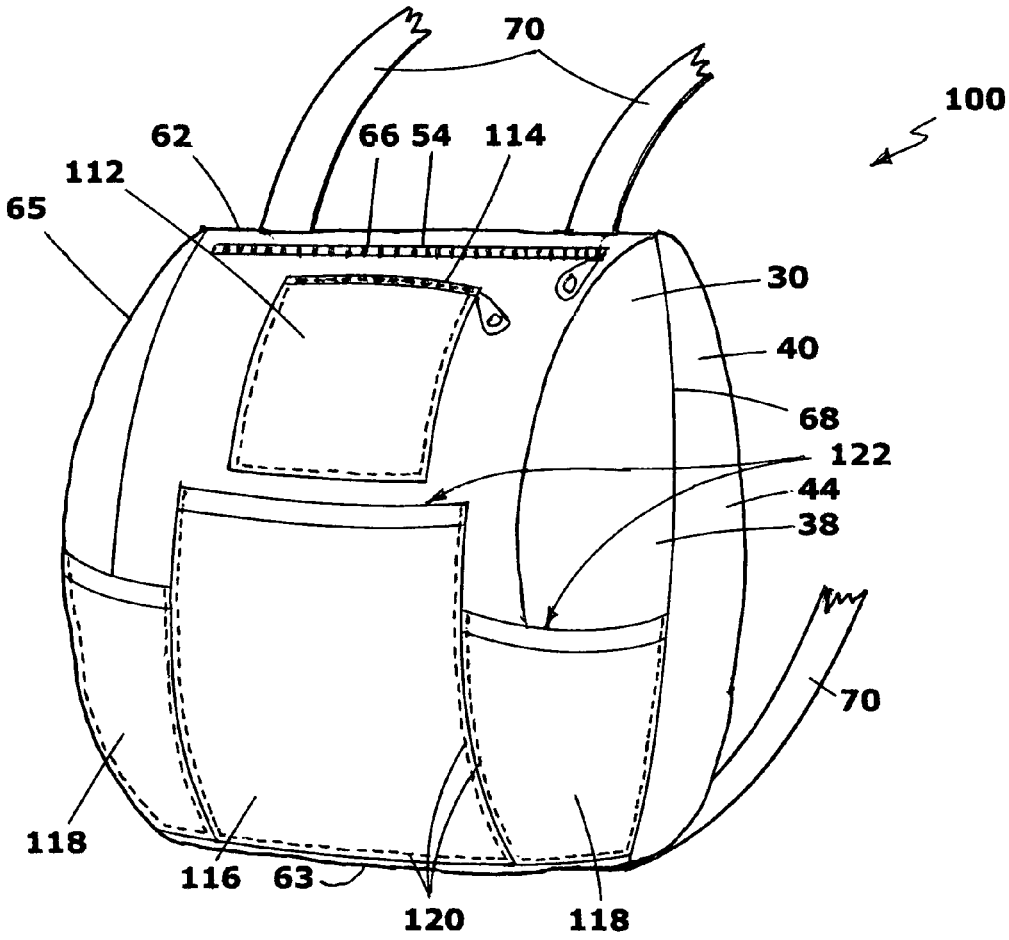
FIG. 11 is a general rear view of a backpack formed by pocket inversion in an upper body garment of FIG. 10, showing added pocket features in accordance with the invention.

In a further embodiment of the upper body garment 10 of this invention, one or more lesser pockets may be formed within invertable pocket 50, so that when pocket 50 is inverted, the lesser pockets appear on the exterior surface 38 and/or exterior surface 44 of backpack 100 for storage of relatively small items. Thus, as shown in the example of FIGS. 10 and 11, upper pocket 112, lower pocket 116, and two side slot pockets 118 are formed of an added fabric layer (or layers) 110. Each lesser pocket 112, 116, 118 is created by joining three of its edges 130 to the underlying layer, shown as the inner surface 38 of the exterior layer 30. Lesser pockets 112, 116, 118 may be formed on either or both of inner pocket surfaces 38 and 44, and will appear on either surface on backpack 100. In the example of FIGS. 10 and 11, the lesser pockets 112, 116, 118 are formed by sew lines 120 along edges 130, leaving unsewed pocket openings 122 for access. Pocket edges 130 may be optionally configured to overlap the circumscribing seam 60, whereby sewing of seam 60 joins the overlapping edges to the underlying layer 30, 40.

The preferred pocket fabrics are those which have a high degree of stretchability and strength, and include net materials.

Any of the lesser pockets 112, 116, 118 may have a closure 114 in its opening 122 so that the pocket may be conveniently closed and opened. In these figures, the closure 114 is depicted as a zipper, but other closures known in the art may be used, including hook-and-loop materials, snaps, and the like.

As illustrated in FIG. 11, the backpack 100 formed by inverting pocket 50 has lesser pockets 112, 114, 118 in convenient locations for carrying smaller items. Items may be carried in the lesser pockets 112, 116, 118 without the need to remove them during conversion to or from a backpack 100, Thus, the overall capacity of the backpack 100 is enhanced without increasing the size of pocket 50.

Figure 12:
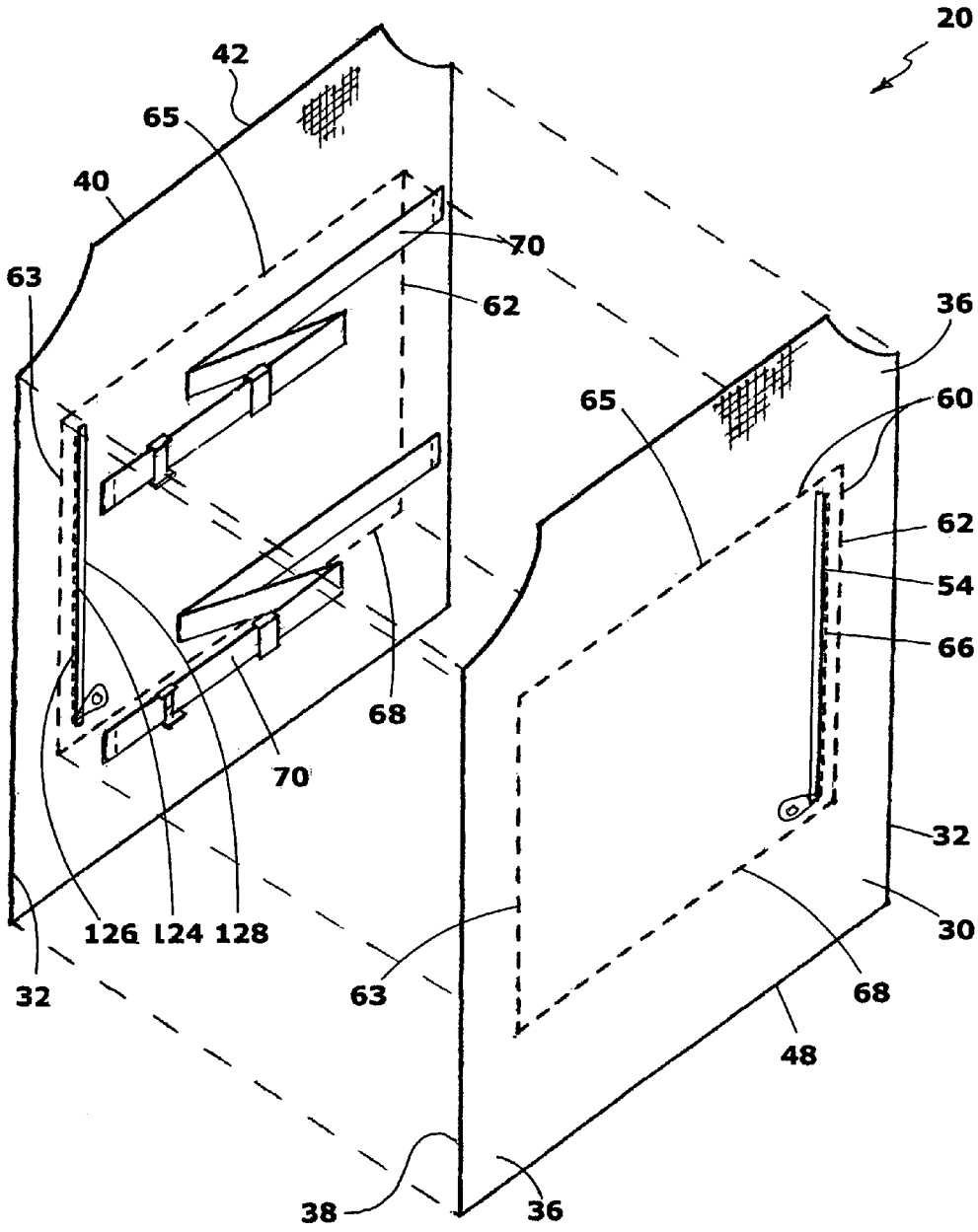
FIG. 12 is a perspective rear view of inner and outer layers of a back panel of a reversible upper body garment having two pocket openings in accordance with the invention.
Figure 13:
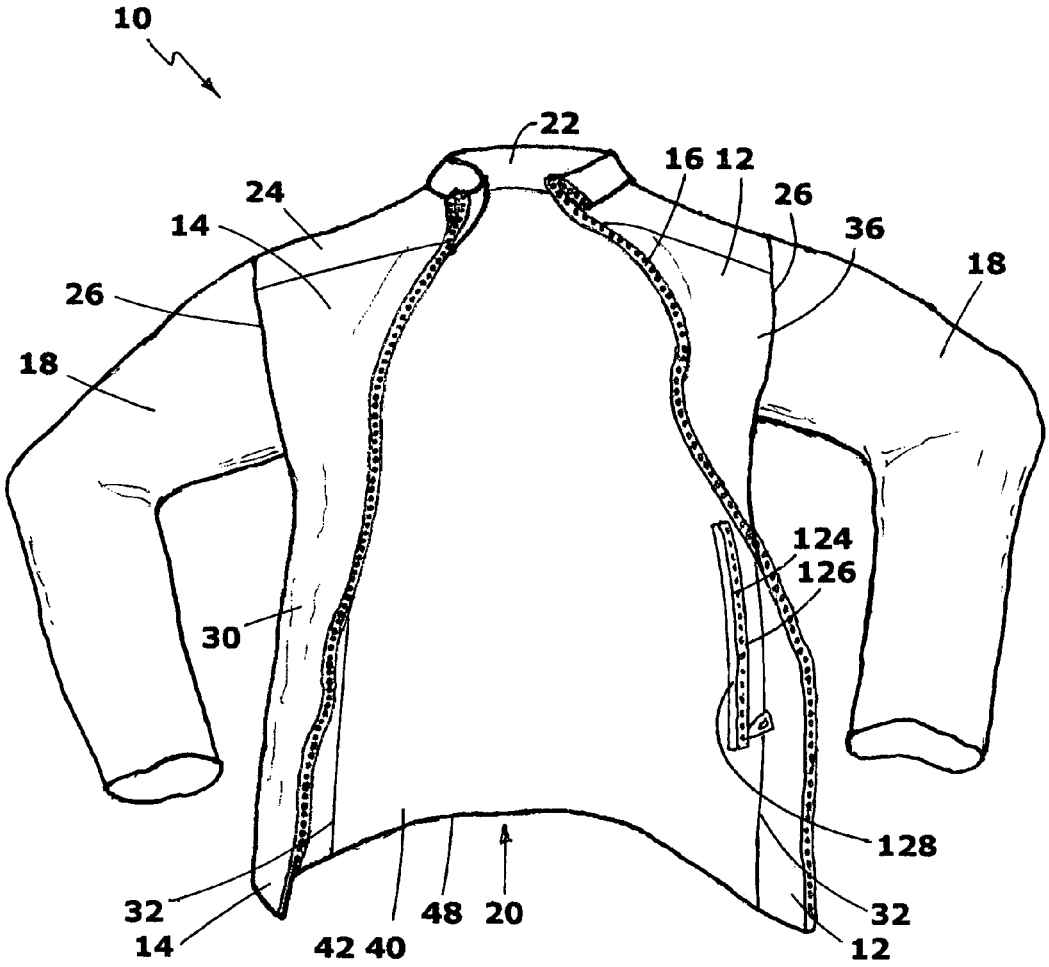
FIG. 13 is a frontal view of a reversible upper body garment having two pocket openings in accordance with the invention.

Turning now to FIGS. 12 and 13, another optional feature of the invention is shown. In a reversible garment 10 wherein the entire garment may be inverted, the pocket opening 54 adjacent seam side 62 on exterior layer 30 may be supplemented with a second pocket opening 124. This pocket opening 124 is adjacent seam side 63 on interior layer 40, i.e. on the opposite side of the opposite end of pocket 50. Thus, when the garment 10 is reversed to expose the interior layer 40 as an exterior layer, the garment retains an external pocket opening. In FIGS. 12 and 13, this second pocket opening 124 is shown as including a closure means 126 (e.g. zipper) and an adjoining welt 128.

From the foregoing description of the invention, the advantages of the convertible garment/backpack 10 are readily seen. The garment 10 has a convenient pocket 50 formed of the garment layers and may be transformed into a backpack 100 merely by reaching into the pocket and withdrawing the inner pocket walls and shoulder straps 70. This action inverts pocket 50, creating a backpack 100 into which the remainder of the garment 10 may be simply stuffed. The backpack 100 is closable by the same closure means 66 as closes pocket 50. The backpack 100 may include one or more pockets 112, 116, 118 on either side of the backpack for carrying items smaller than the garment 10, and these pockets are invisible when the garment 10 is not in a backpack mode. The construction of a pocket 50 in a garment in accordance with this invention is relatively simple, even when several fabric interlayers, including an insulative layer, are included in the garment between the exterior layer 30 and interior lining layer 40.

It is evident to those skilled in the art that various changes and modifications may be made in the methods and apparatus of the invention as disclosed herein without departing from the spirit and scope of the invention as defined in the following claims.

What is claimed is:

1. A self-packable upper body garment for a person, comprising:

an upper body garment having a front portion and a back portion with lateral sides proximate the sides of a wearer, the garment having a yoke panel on said back portion and sleeve openings wherein said sleeve openings are proximate a respective intersection of said front portion, said back portion, and said yoke panel, said back portion comprising: an exterior outer shell layer;

an outer shell layer;

an inner lining layer generally overlain by said exterior outer shell layer;

a circumscribing seam joining said exterior outer shell layer to said inner lining layer in a circumscribed pattern to form a first pocket therein of confined space between said exterior outer layer and said inner layer;

an elongate, generally vertical pocket opening through said exterior outer shell layer and proximate one of said lateral sides for hand access to said first pocket;

closure means for opening and closing said vertical pocket opening; and two elongate backpack straps positioned within said first pocket and having strap ends opposedly attached to said circumscribing seam;

wherein said first pocket spans a portion of said back portion between said lateral sides of said back.

2. A self-packable upper body garment according to claim 1, wherein said vertical pocket opening is aligned substantially below one of said sleeve openings of said garment.

3. A self-packable upper body garment according to claim 1, further comprising at least one intermediate layer of insulative material positioned in at least one of (a) between said exterior outer shell layer and said inner lining layer, (b) between said exterior outer shell layer and an interlayer, (c) between said inner lining layer and an interlayer, and (d) between two interlayers.

4. A self-packable upper body garment according to claim 1, further comprising at least one fabric interlayer between said exterior outer shell layer and said inner lining layer.

5. A self-packable upper body garment according to claim 4, wherein said at least one fabric interlayer comprises at least one of an opposed inner walls of said first pocket.

6. A self-packable upper body garment according to claim 1, further comprising:

a second elongate, generally vertical pocket opening through said inner lining layer and proximate one of said lateral sides for hand access through said inner lining layer to said first pocket; and closure means for opening and closing said second vertical pocket opening.

7. A self-packable upper body garment according to claim 6, wherein said first pocket opening and said second pocket opening are opposedly positioned on said first pocket.

8. A self-packable upper body garment according to claim 6, wherein said garment may be reversed wherein said inner lining layer is used as said garment exterior, and said second pocket opening is on the exterior of said garment.

9. A self-packable upper body garment according to claim 1, further comprising a reduced size pocket attached to an pocket wall within said first pocket.

10. A self-packable upper body garment according to claim 1, further comprising an insulative lining removably attached to said inner lining layer, said removable insulative lining comprising:

a first layer configured to face said wearer;

a second layer having a portion configured to face said inner lining layer;

a third layer intermediate said first layer and said portion of said second layer;

a second joinder seam joining said second and third layers in a circumscribed pattern to form a secondary pocket therebetween of confined space;

a pocket opening through one of said first layer, said first and third layers, said second layer, and said second and third layers; and two elongate backpack straps positioned within said secondary pocket and having strap ends opposedly attached to said second joinder seam;

wherein said secondary pocket is configured to be inverted to enclose said insulative lining as a backpack.

11. A self-packable upper-body garment according to claim 1, wherein said exterior outer shell comprises one of fabric and leather.

12. A self-packable upper-body garment according to claim 1, further comprising a waist belt formed within said pocket for stabilizing the lower portion of said self-packable garment to said person's body.

13. A self-packable upper-body garment according to claim 12, wherein said waist belt is attached to said circumscribing seam of said garment.

14. A self-packable upper-body garment according to claim 1, further comprising a sternum strap cojoining said backpack straps in a mid position corresponding to the sternum of said person.

15. A self-packable upper-body garment according to claim 1, further comprising at least one lesser pocket having an opening into the interior of said first pocket.

* * * * *